United States Patent [19]

Carolus et al.

[11] 4,236,162

[45] Nov. 25, 1980

[54] ANTENNA ACTUATOR WITH A LOCATING AND REACTION SUPPORT SURFACE FOR THE CABLE STORAGE DRUM

[75] Inventors: David T. Carolus; Ralph W. Edwards, both of Dayton; John R. Powell, Bellbrook, all of Ohio

[73] Assignee: General Motors Corporation, Detroit, Mich.

[21] Appl. No.: 47,068

[22] Filed: Jun. 11, 1979

[51] Int. Cl.[3] ..... H01Q 1/10

[52] U.S. Cl. ..... 343/903; 242/54 A

[58] Field of Search ..... 343/903, 901; 242/54 A

[56] References Cited

FOREIGN PATENT DOCUMENTS 44-17923 8/1969 Japan ..... 343/903

*Primary Examiner*—David K. Moore

*Attorney, Agent, or Firm*—Donald Scherer

[57] ABSTRACT

A power antenna actuator mechanism has a worm and gear drive for a cable storage drum which is integral with the worm gear. A covering, which cooperates with a housing to enclose the actuator mechanism, has a rib portion which abuts a circumferential surface of the storage drum for an arcuate distance adjacent the mesh point of the worm and worm gear to provide a support member for the storage drum in a radial direction transverse to the axis of the worm.

1 Claim, 2 Drawing Figures

ANTENNA ACTUATOR WITH A LOCATING AND REACTION SUPPORT SURFACE FOR THE CABLE STORAGE DRUM

This invention relates to antenna actuator mechanisms and more particularly to support structures for rotatable storage drums used in antenna actuator mechanisms.

It is an object of this invention to provide an improved power antenna actuator mechanism having a support rib for the cable storage drum adjacent the gear drive connection to said drum.

Another object of this invention is to provide an improved power antenna actuator structure wherein a cable storage drum is driven in rotation by a worm and worm gear drive and wherein a locating support rib contacts the storage drum adjacent the mesh and worm gear to prevent movement of the storage drum in a direction transverse to the worm.

Figure 1:
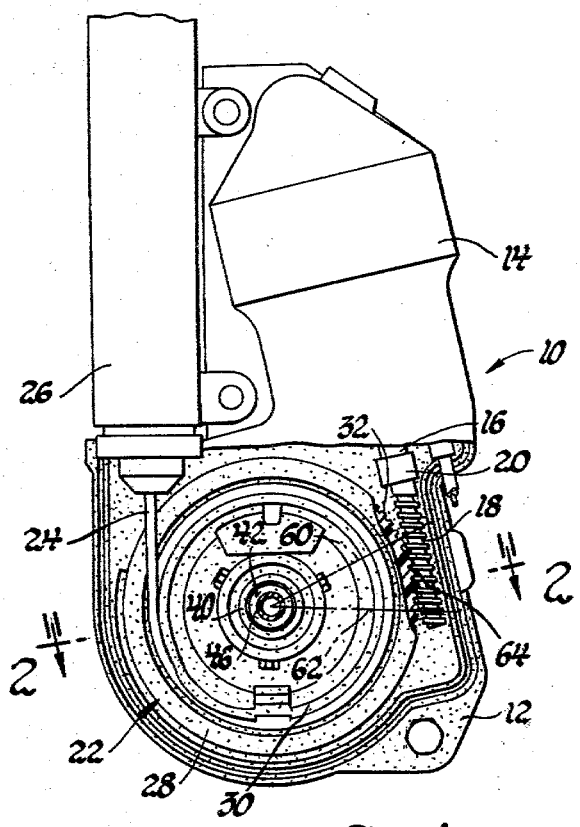
Figure 2:
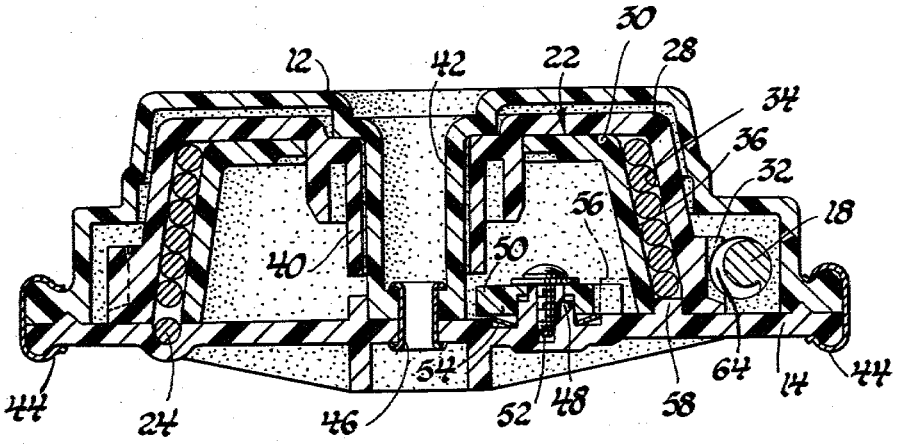

These and other objects and advantages of the present invention will be more apparent from the following description and drawings in which :

FIG. 1 is a side elevational view of a power antenna and drive mechanism; and FIG. 2 is a sectional view taken along line 2—2 of FIG. 1.

Referring to the drawings, wherein the same characters represent the same or corresponding parts throughout the several views, there is seen an antenna drive mechanism, generally designated 10, having a housing 12 and a cover 14. A conventional electric motor, not shown, is disposed in the housing 12 beneath cover 14 and has an output shaft 16 which drives a worm 18. A reaction switch 20 is operatively connected to the output shaft 16 and is preferably constructed in accordance with the reaction switch shown in U.S. Ser. No. 900,051, filed Apr. 26, 1978, and assigned the assignee of the present invention.

A drum assembly, generally designated 22, houses a cable 24 which is connected to drive a conventional telescoping antenna, not shown, housed in a mast jacket 26. The drum 22, as best seen in FIG. 2, is comprised of an outer member 28 and an inner member 30 which are similar in construction to the members shown in the drive drum disclosed in U.S. Ser. No. 938,752, filed Sept. 1, 1978, now U.S. Pat. No. 4,181,268 and assigned to the assignee of the present invention.

The outer member 28 has formed on the outer periphery thereof, a worm gear 32 which meshes with the worm 18. A frustoconical surface 34 formed on and inner surface of member 28, which surface 34 cooperates with a frustoconical surface 36 on the outer surface of inner member 30 to form a storage space for the cable 24. The outer member 28 has an inner cylindrical component 40 which is rotatably mounted on and slightly spaced from a cylindrical member 42 formed integrally with the housing 12. The cable 24 is stored in the space formed between the frustoconical surfaces 34 and 36 and is drivingly connected to the inner member 30 such that when the drum assembly 22 is rotated by the electric motor, the cable 24 will be extended from or retracted into the storage drum depending upon the direction of rotation of the electric motor.

The cover 14 is secured to the housing 12 by a plurality of spring clips 44 and a rivet member 46. A post 48 is formed integrally with the cover 14 and has rotatably disposed thereon a gear member 50 which is maintained in longitudinal position on the post 48 by a fastener 52. A spring washer 54 is disposed between the cover 14 and the gear member 50 and imposes an axial load between the gear 50 and the fastener 52 such that the gear member 50 will not be freely rotatable but must require a slight input force for rotation. Rotation of the gear member 50 is accomplished by a single tooth 56, shown in phantom outline, which tooth 56 is formed integrally with the inner member 30 such that as the inner member 30 makes one complete revolution, the gear member 50 will be moved one tooth space in either a clockwise or counterclockwise direction depending upon the direction of rotation of the drive drum 22. The single tooth 56 and gear member 50 cooperate to impose a resistance to the rotation of drum assembly 22, as described in U.S. Ser. No. 962,922, filed Nov. 22, 1978, now U.S. Pat. No. 4,190,842 and assigned to the assignee of the present invention.

The cover 14 has a rib 58 which extends axially into the storage space provided between surfaces 34 and 36. The rib 58 is arcuate in shape and extends between the radial lines 60 and 62 shown in FIG. 1.

As can be seen in FIG. 2, the rib 58 is in an abutting relationship with the upper portion of surface 34 at a position substantially opposite the mesh point 64 between worm 18 and worm gear 32. The driving action between the worm 18 and worm gear 32 has a reaction force which tends to separate the worm 18 from worm gear 32 in a direction transverse to the axis of worm 18. The rib 58 prevents movement of the drum assembly 22 in a direction transverse to the axis of worm 18. By providing a reaction surface through which the forces created can be transmitted directly to the cover, the possibility of gear teeth separation and stripping of the teeth from the worm or worm gear is greatly reduced.

To accomodate the suppporting function of the rib 58, the cylindrical component 40 has the inner diameter sized thereof to provide a clearance with the cylindrical component 42. Thus, there is sufficient movement possible in a direction normal to the axis of worm 18 to accommodate production tolerances which will be inherent in the manufacture of cover 14. The clearance between cylindrical component 40 and cylindrical component 42 will permit the drum assembly to move in a direction longitudinal to the worm 18, however, this movement will not affect the operation of the antenna actuator.

The embodiments of the invention in which an exclusive property or privilege is claimed are defined as follows:

1. An improvement in power antenna actuators having a cable storage drum rotatably supported in a housing and driven by a worm which meshes with a worm gear formed integrally with the cable storage drum, said cable storage drum including a pair of cooperating frustoconical members between which the cable is stored, and a cover member enclosing the housing, wherein the improvement comprises; asupport rib formed in the cover and extending between the frustoconical members adjacent the mesh point of the worm and worm gear, said support rib preventing the frustoconical members from shifting transversely to the axis of the worm.

* * * * *